US006405892B1

(12) United States Patent
Volan

(10) Patent No.: US 6,405,892 B1
(45) Date of Patent: Jun. 18, 2002

(54) THERMALLY INSULATED BEVERAGE GLASS

(76) Inventor: Ken Michael Volan, 11500 Aaron Dr., Parma, OH (US) 44130

( * ) Notice: Subject to any disclaimer, the term of this patent is extended or adjusted under 35 U.S.C. 154(b) by 0 days.

(21) Appl. No.: 09/777,991

(22) Filed: Feb. 6, 2001

(51) Int. Cl.[7] ..... B65D 6/10
(52) U.S. Cl. ..... 220/592.17; 215/12.1
(58) Field of Search ..... 220/592.17, 592.23, 220/662; 215/12.1

(56) References Cited

U.S. PATENT DOCUMENTS

| | | | | |
|---|---|---|---|---|
| 2,725,733 A | * | 12/1955 | Davis | 220/592.17 X |
| 2,895,636 A | * | 7/1959 | Martin | 215/12.1 X |
| 3,156,279 A | * | 11/1964 | Grebowiec et al. | 215/12.1 |
| 3,766,975 A | * | 10/1973 | Todd | 215/12.1 X |
| 4,007,670 A | | 2/1977 | Albano et al. | |
| 4,632,273 A | | 12/1986 | Rhine | |
| 4,720,023 A | | 1/1988 | Jeff | |
| 5,005,717 A | | 4/1991 | Dilar | |
| 5,253,780 A | | 10/1993 | Adado | |
| 5,261,554 A | | 11/1993 | Forbes | |
| D372,168 S | | 7/1996 | Seager | |
| 6,010,062 A | | 1/2000 | Shimono | |
| 6,050,443 A | * | 4/2000 | Tung | 220/592.17 |

* cited by examiner

*Primary Examiner*—Steven Pollard
(74) *Attorney, Agent, or Firm*—John D. Gugliotta

(57) ABSTRACT

A thermally insulated beverage glass is provided as an insulated drinking glass made from glass with an interstitial space in the sides and bottom. The sides and bottom of the glass are double-walled, forming an interstitial space for insulating purposes. The interstitial space can be left filled with air, or filled with an insulating material such as Styrofoam®. The interstitial space not only reduces or eliminates condensation from forming on the exterior of the glass when filled with cold liquid on hot, humid days, but it also helps keep the liquid cooler. Alternately, when the glass is filled with hot liquid it also aids in keeping the liquid hotter, longer.

7 Claims, 4 Drawing Sheets

THERMALLY INSULATED BEVERAGE GLASS

RELATED APPLICATIONS

The present invention was first described in Disclosure Document No. 477,575 filed on Jul. 28, 2000. There are no previously filed, nor currently any co-pending applications, anywhere in the world.

BACKGROUND OF THE INVENTION

1. Field of the Invention

The present invention relates generally to insulated drinking containers and, more particularly, to a thermally insulated beverage glass.

2. Description of the Related Art

Nothing is more refreshing on a hot day than a cold beverage such as ice tea, soda, beer, ice water or the like. However, one must deal with the "sweating" or condensation that forms on the exterior of a glass. This sweating may leave puddles on the table, which may cause damage if the table is made of wood. The condensation also causes a safety problem should the glass slip from ones hand when picking it up. One method of reducing such problems is the use of insulated plastic glasses. While plastic glasses with insulating walls do cut down on condensation on the exterior of the glass, many people do not like plastic, due to its cheaper feel, and would as such, not be used in finer restaurants.

Accordingly, a need has developed for insulated drinking glasses made from glass, so that cold beverages can be enjoyed without glass condensation problems. The development of the thermally insulated beverage glass fulfills this need.

A search of the prior art did not disclose any patents that read directly on the claims of the instant invention; however, the following references were considered related. The following patents disclose the design and function of an insulated drinking cup or container: U.S. Pat. No. 6,010,062 issued in the name of Shimono; U.S. Pat. No. 5,261,554 issued in the name of Forbes; U.S. Pat. No. 5,253,780 issued in the name of Adado; U.S. Pat. No. 5,005,717 issued in the name of Oilar; U.S. Pat. No. 4,007,670 issued in the name of Albano et al.; and U.S. Pat. No. D 372,168 issued in the name of Seager.

U.S. Pat. No. 4,720,023 issued in the name of Jeff describes a combination insulated mug and beverage can holder.

U.S. Pat. No. 4,632,273 issued in the name of Rhine discloses a disposable insulated container and drinking cup combination.

U.S. Pat. No. 4,151,923 issued in the name of Bernardi describes a thermally insulated pre-chill drinking glass.

Consequently, a need has been felt for providing a device which provides a means to enjoy a cold beverage without the aggravations and disadvantages of condensation or sweating.

SUMMARY OF THE INVENTION

Therefore, it is an object of the present invention to provide a beverage glass which is great for cold beverages such as beer, soda, tea, water and the like.

It is another object of the present invention to provide a beverage glass which eliminates or reduces condensation on the outside of the glass.

It is still another object of the present invention to provide a beverage glass with double walls which provides an insulating, interstitial space.

It is still another object of the present invention to provide a beverage glass with double walls which keeps the outer wall at a warmer temperature so as to keep the glass from sweating.

It is another object of the present invention to provide a beverage glass with double walls which keeps beverages colder or warmer.

It is another object of the present invention to provide a beverage glass with double walls which prevents one's hands from warming the beverage as well.

It is another object of the present invention to provide an interstitial space which can be left filled with air, thus forming a vacuum therein.

It is another object of the present invention to provide an interstitial space which can be filled with Styrofoam®, or other insulating material to further enhance insulating qualities.

It is another object of the present invention to provide an interstitial space which can be filled with decorative insulating material as well for aesthetic qualities.

It is another object of the present invention to provide a smooth rim which presents no danger to the user.

Briefly described according to one embodiment of the present invention, a thermally insulated beverage glass is an insulated drinking glass made from glass with an interstitial space in the sides and bottom. Upon initial observation, the invention looks remarkably like a conventional drinking glass. But after closer inspection, it can be seen that the sides and bottom of the glass are double-walled, forming an interstitial space for insulating purposes. The interstitial space can be left filled with air, or filled with an insulating material such as Styrofoam®. Other decorative insulating materials can be placed in the interstitial space as well. An optional hemispherical member, located on the bottom of the inner side wall of the glass, is used to increase structural integrity of the glass. The interstitial space not only reduces or eliminates condensation from forming on the exterior of the glass when filled with cold liquid on hot, humid days, but it also helps keep the liquid cooler.

The use of the present invention provides a means to enjoy a cold beverage without the aggravations and disadvantages of condensation or sweating.

BRIEF DESCRIPTION OF THE DRAWINGS

The advantages and features of the present invention will become better understood with reference to the following more detailed description and claims taken in conjunction with the accompanying drawings, in which like elements are identified with like symbols, and in which:

DESCRIPTION OF THE PREFERRED EMBODIMENT

1. Detailed Description of the Figures

Figure 1:
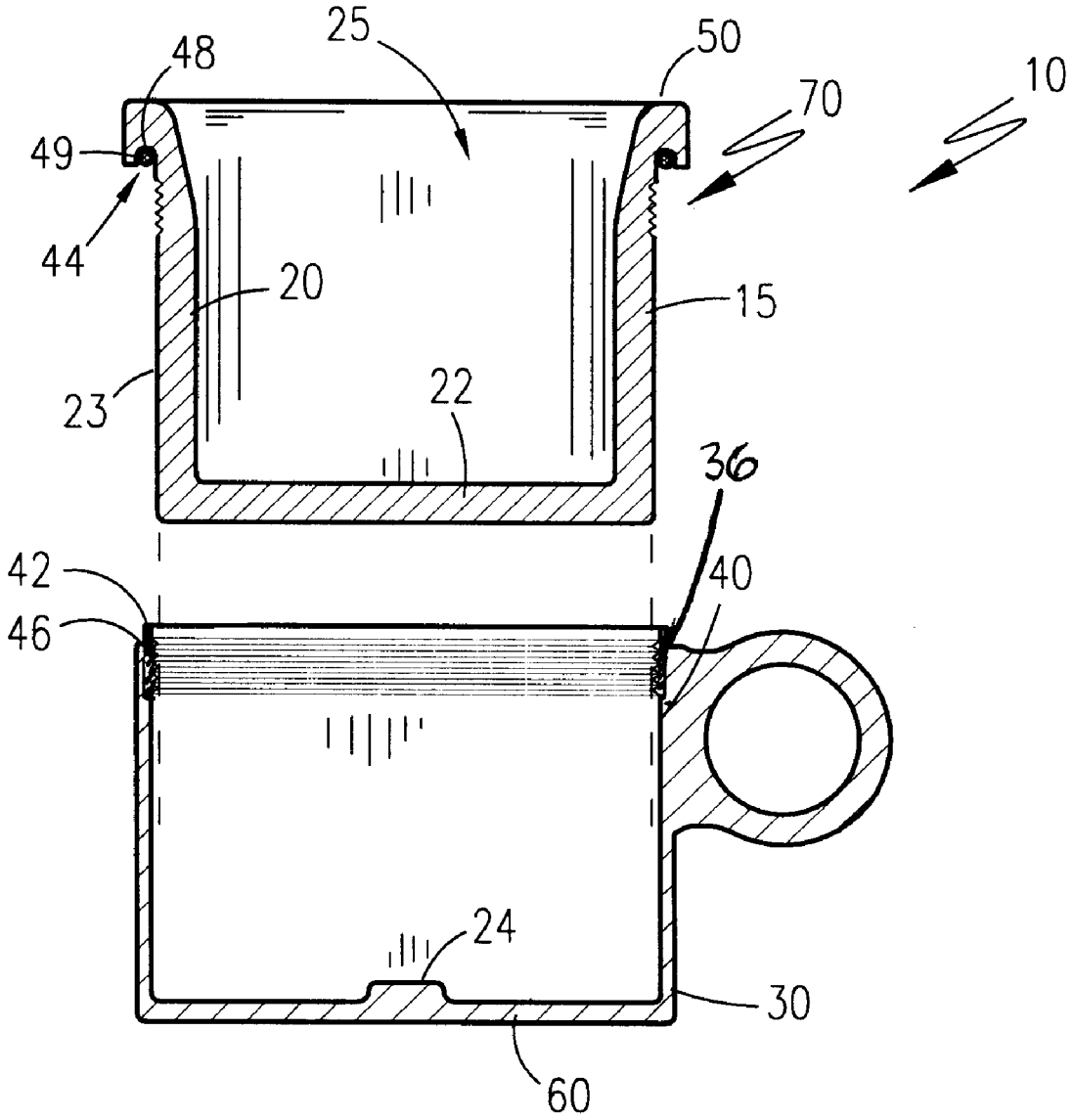
FIG. 1 is a side elevational cross sectional view of a thermally insulated beverage glass according to the preferred embodiment of the present invention.
Figure 2A:
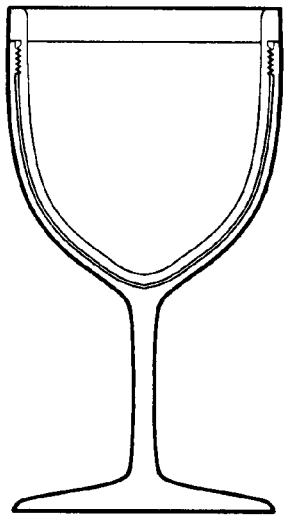
FIGS. 2*a*–2*d* show various geometric-shaped drinking containers according to the present invention.
Figure 2B:
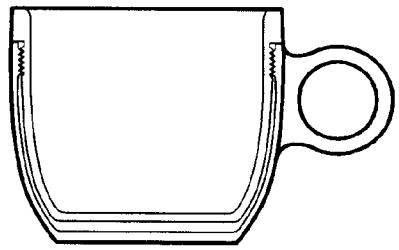
Figure 2C:
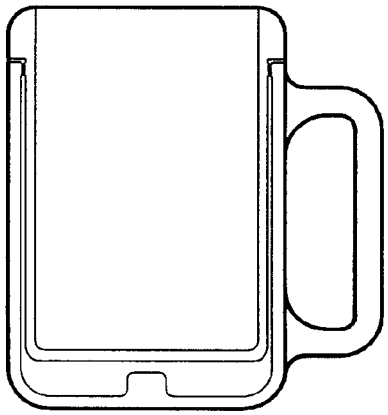
Figure 2D:
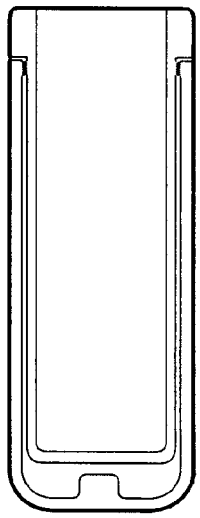
Figure 3:
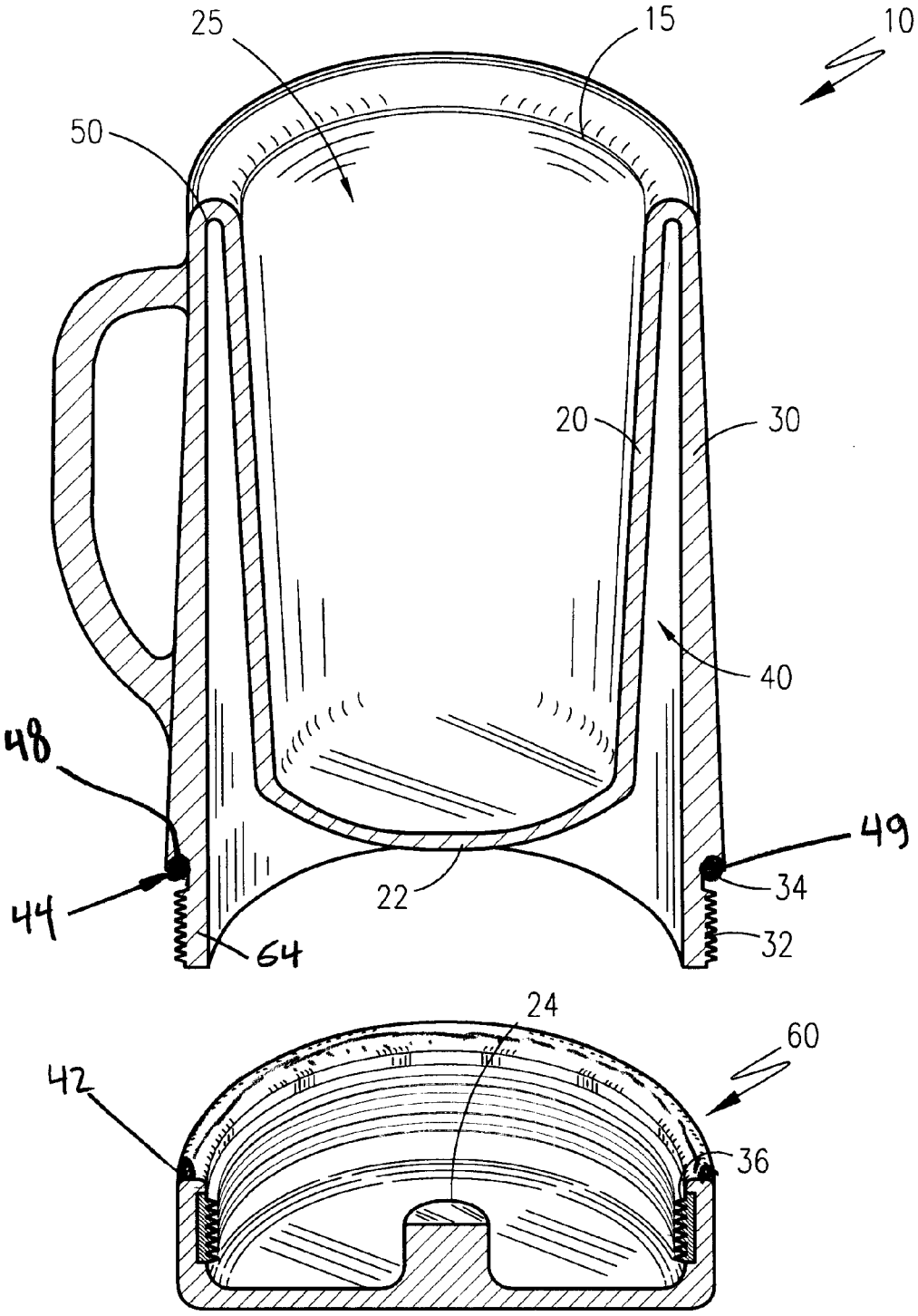
FIG. 3 is a perspective view of a thermally insulated beverage glass according to an alternate embodiment of the present invention shown in cross section along the vertical centerline according to the preferred embodiment of the present invention.
Figure 4:
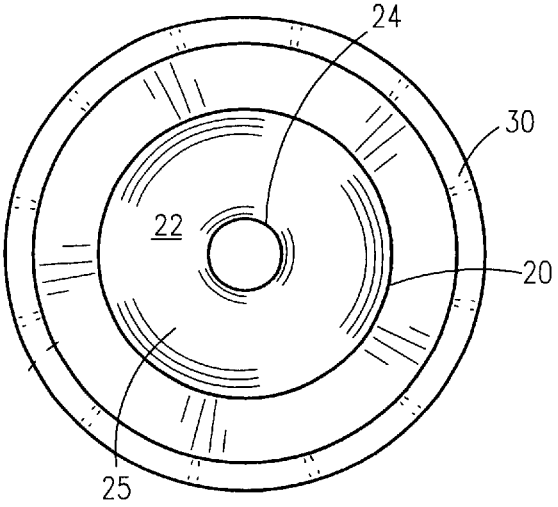
FIG. 4 is a top plan view thereof.
Figure 5:
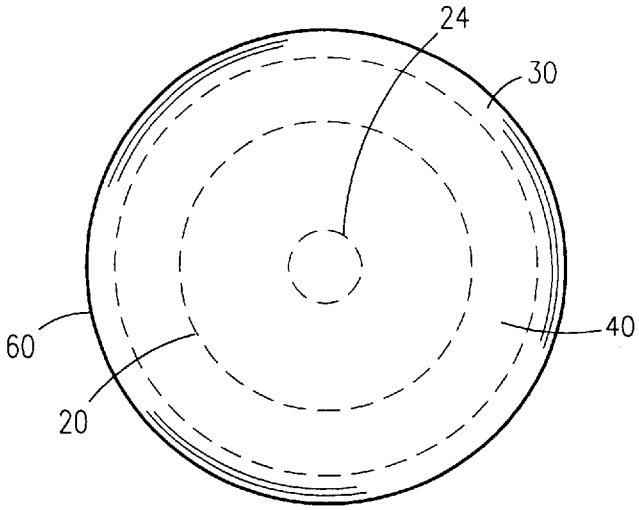
FIG. 5 is a bottom plan view thereof.

Referring now to FIGS. 1 and 4–6, a thermally insulated beverage glass 10 is shown, according to the preferred embodiment of the present invention. In this embodiment, the generally tubular glass member 15 which includes an inner sidewall 20 that forms male connection threads 70 along the circumferential sidewall 23 thereoff, closer to the rim 50. The rim 50 is tapered out to form a drinking lip, as shown. An outer sidewall 30 integrally includes a circular bottom support wall 60.

The tubular glass member 15 is an insulated drinking glass with a cylindrical-shaped inner sidewall 20 and a substantially vertical circumferential sidewall 23.

The inner sidewall 20 forms a hollow interior 25 designed to receive beverages. The inner sidewall 20 is inwardly offset relative to the outer sidewall 30 so as to insertably engage within the outer sidewall 30 along most of the vertical height. The inner sidewall 20 includes a circular bottom wall 22. In the event that additional vertical support is required for the tubular glass member 15, it is envisioned that the lower circular bottom support wall 60 can optionally includes an upwardly extending, integral support member 24 for providing structural integrity to the bottom wall 22, and thereby the inner sidewall 20 as well.

The inner sidewall 20 and the outer sidewall 30 are joined in a threaded fashion together so as to form a drinking glass, wherein an interstitial space 40 is defined between them which divides and thermally insulates the inner sidewall 20 along both the bottom wall 22 and circumferential sidewalls 23 thereof. Upon engagement of the outer sidewall 30 over and onto the tubular glass member 15 a seal is formed to isolate the interstitial space 40, forming an isolated airspace. In order to provide such a seal, a first mating surface 42 for engaging with a second mating surface 44. The first mating surface 42 is shown as an upwardly extending protrusion from the upper peripheral rim of the outer sidewall 30. The protrusion is offset inward by a notch 46. In alignment with the first mating surface, the second mating surface is shown as an inwardly formed receiving cavity 48 circumscribing the vertical circumferential sidewall 23 of the tubular glass member 15. The receiving cavity 48 aligns with and receives the upwardly extending protrusion, such as when sealed will form a tortuous path to access the interstitial space 40. Additionally, a sealing member 49 can be placed within the receiving cavity 48. When formed of a clear pliable material, such as a deformable elastomer, when the receiving cavity 48 aligns with and receives the upwardly extending protrusion and tightened the sealing member 49 will deform, forcing against the available space and forming a hermetic seal of the interstitial space. Although the threads can be formed within the outer sidewall 30, an alternate method as shown is a threaded insert 36, formed separately of clear plastic or other formable material, for attachment into a receiving notch formed within the inner side of the outer sidewall 30. In this manner, the bottom support wall 60 can be easily formed of glass or the like, with the threads adhered thereto without the need of machining or other difficult or complicated manufacturing. It is also anticipated that, alternately, the outer sidewall 30 can be adhered or thermally formed directly to the tubular glass member 15 by a suitable bonding means including chemical or suitable adhesive or cohesive means as is known in the art for fusing in order to form a one-piece, non-separable unit. According to such a design, the present invention can thereby be formed either of glass, or injected molded of plastic or similar material.

Finally, as shown in conjunction with FIGS. 2*a*–2*d*, it is envisioned that the present invention may be designed in various geometric-shaped drinking containers including but not limited to coffee mugs, wine glasses, tumblers, beer mugs, and high ball glasses.

Referring now to FIGS. 3–6, a thermally insulated beverage glass 10 is shown, according to the present invention, comprised of a generally tubular glass member 15 which includes an inner sidewall 20, an outer sidewall 30, an interstitial space 40, and a circular bottom support wall 60.

The tubular glass member 15 is an insulated drinking glass with a cylindrical-shaped inner sidewall 20 and a substantially vertical annular outer sidewall 30. The inner sidewall 20 forms a hollow interior 25 designed to receive beverages. The inner sidewall 20 is inwardly offset relative to the outer sidewall 30 so as to be positioned within the outer sidewall 30 along most of the vertical height. The inner sidewall 20 includes a circular bottom wall 22. Terminating the lower, outer periphery of the outer sidewall 30 are a series of threads 32 forming a male threaded connection. The male threaded connection is recessed below the outermost surface of the outer sidewall 30 in an offset inward manner by a notch 34. A lower circular bottom support wall 60 forms or receives a series of threads 36 forming a female threaded connection for threadably engaging with the threads 32 that form a male threaded connection. Although the threads can be formed within the vertical sidewall surface of the lower support wall 60, as shown is a clear threaded insert, formed separately of plastic or other formable material, for attachment into a receiving notch formed within the bottom support wall 60. In this manner, the bottom support wall 60 can be easily formed of glass or the like, with the threads adhered thereto without the need of machining or other difficult or complicated manufacturing. Also, the lower circular bottom support wall 60 optionally includes an upwardly extending, integral support member 24 for providing structural integrity to the bottom wall 22, and thereby the inner sidewall 20 as well.

In order to provide such a seal, a first mating surface 42 for engaging with a second mating surface 44. The first mating surface 42 is shown as an upwardly extending protrusion from the upper peripheral rim of the bottom support wall 60. In alignment with the first mating surface 42, the second mating surface 44 is shown as an inwardly formed receiving cavity 48 circumscribing the vertical annular lower portion 54 of the tubular glass member 15. The receiving cavity aligns with and receives the upwardly extending protrusion 42, such as when sealed will form a tortuous path to access the interstitial space 40. Additionally, a sealing member 49 can be placed within the receiving cavity. When formed of a clear pliable material, such as a deformable elastomer, when the receiving cavity aligns with and receives the upwardly extending protrusion 42 and tightened the sealing member 49 will deform, forcing against the available space and forming a hermetic seal of the interstitial space 40.

The inner sidewall 20 is designed to project upwards and attach to the outer sidewall 30 so as to form a rim 50. The rim 50 defines an open top leading to the hollow interior 25.

The inner sidewall 20 and the outer sidewall 30 are joined together so as to form a drinking glass, wherein an interstitial space 40 is defined between them which divides and thermally insulates the inner sidewall 20 along both the bottom wall 22 and inner sidewall 20 thereof. The inner sidewall 20 and the outer sidewall 30 are fused about rim 50 by hot molding or hot thermosetting adhesive, thereby suspending the inner sidewall 20 from the rim 50. According to such a design, the present invention can thereby be formed either of glass, or injected molded of plastic or similar material.

Figure 6:
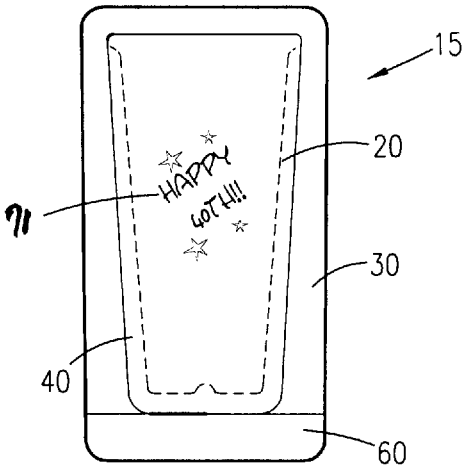
FIG. 6 is a side elevational view of the present invention wherein the interstitial space is shown filled with decorative insulating material according to the preferred embodiment.

Referring now to both embodiments shown and described in FIGS. 1–5, it is envisioned that the interstitial space 40 may be filled with decorative insulating material 71, shown in conjunction with FIG. 6, such as Styrofoam® which provides an ornamental quality to the present invention. It is further envisioned that the decorative insulating material will be comprised of ornamental designs depicting celebrations, seasons, holidays, and other occasions.

The interstitial space 40 serves to maintain the outer sidewall 30 with a warmer temperature than the inner sidewall 20, thus preventing condensation from forming on the outer sidewall 30. The resulting functionality of the interstitial space 40 serves not only to keep beverages colder and to prevent a user's hands from warming the beverage, but also to prevent slippage of the present invention from the user's hands as is a common occurrence when condensation forms on an exterior surface of a typical glass. The insulated inner sidewall 20 would also serve to keep coffee or other hot beverages in a hot condition for an extended period of time.

In the event the interstitial space 40 is filled with decorative insulating material 71, such material 71 would necessarily be resistant to hot molding. This will prevent decomposition of the material, should the use of threaded connections not be utilized but replaced by a thermal forming attachment method.

2. Operation of the Preferred Embodiment

To use the present invention, the user simply pours a desired beverage within the hollow interior 25 and drinks from the rim 50 of the present invention like any other drinking glass. The interstitial space 40 serves to insulate the beverage from the outer sidewall 30 of the glass thus preventing condensation from forming thereon. The resulting functionality of the interstitial space 40 serves not only to keep beverages colder and to prevent a user's hands from warming the beverage, but also prevents slippage of the glass from the user's hands.

The use of the present invention provides a means to enjoy a cold beverage without the aggravations and disadvantages of condensation or sweating.

Therefore, the foregoing description is included to illustrate the operation of the preferred embodiment and is not meant to limit the scope of the invention. As one can envision, an individual skilled in the relevant art, in conjunction with the present teachings, would be capable of incorporating many minor modifications that are anticipated within this disclosure. Therefore, the scope of the invention is to be broadly limited only by the following claims.

What is claimed is:

1. A thermally insulated beverage glass comprising:

a generally tubular glass member having an inner sidewall supporting a threaded connection along an upper portion near a rim, said rim tapered out to form a drinking lip and said tubular glass member having an outer sidewall integrally forming a circular bottom support wall and a cylindrical-shaped inner sidewall and a substantially vertical annular outer sidewall;

an outer sidewall;

said inner sidewall forming a hollow interior designed to receive beverages, said inner sidewall inwardly offset relative to the outer sidewall so as to insertably engage within the outer sidewall along most of a vertical height, wherein said inner sidewall and said outer sidewall are joined in a threaded fashion together so as to form a drinking glass, wherein an interstitial space is defined between them which divides and thermally insulates the inner sidewall along both the bottom wall and circumferential sidewalls thereof;

a decorative insulating material placed within said interstitial space.; and a first mating surface for engaging with a second mating surface, said first mating surface being an extending protrusion from a peripheral rim of said outer sidewall and offset inward by a notch in alignment with said second mating surface being an inwardly formed receiving cavity circumscribing the vertical circumferential sidewall of the tubular glass member, wherein said receiving cavity aligns with and receives said extending protrusion, such as when sealed will form a tortuous path to access the interstitial space;

wherein upon engagement of said outer sidewall over and onto tubular glass member a seal is formed to isolate the interstitial space, forming an isolated airspace.

2. The thermally insulated beverage glass of claim 1, further comprising a sealing member placed within said receiving cavity.

3. The thermally insulated beverage glass of claim 2, wherein said sealing member is formed of a pliable material.

4. The thermally insulated beverage glass of claim 1, wherein said threaded connection is integrally formed within said inner sidewall.

5. The thermally insulated beverage glass of claim 1, wherein said threaded connection comprises:

a threaded insert formed of a formable material for attachment into a receiving notch formed within said inner side of said outer sidewall.

6. The thermally insulated beverage glass of claim 1, wherein said threaded insert is formed of a clear material.

7. The thermally insulated beverage glass of claim 1, wherein said inner sidewall includes a circular bottom wall and forms an upwardly extending, integral support member for providing structural integrity to the bottom wall, and thereby the inner sidewall as well.

* * * * *